US006260701B1

(12) United States Patent
Katayama et al.

(10) Patent No.: US 6,260,701 B1
(45) Date of Patent: Jul. 17, 2001

(54) DRILL BIT CASE WITH RE-CONFIGURABLE SHANK RETAINER AND STAND BASE

(75) Inventors: Ichiro Katayama, Tokyo; Yoshiharu Shinbo, Nagaoka, both of (JP)

(73) Assignee: Union Tool Company Ltd. (JP)

( * ) Notice: Subject to any disclaimer, the term of this patent is extended or adjusted under 35 U.S.C. 154(b) by 0 days.

(21) Appl. No.: 09/183,721

(22) Filed: Oct. 30, 1998

(Under 37 CFR 1.47)

(30) Foreign Application Priority Data

Oct. 31, 1997 (JP) ..... 9-299837

(51) Int. Cl.[7] ..... B65D 85/28

(52) U.S. Cl. ..... 206/379; 206/443; 206/815; 312/350; 312/902

(58) Field of Search ..... 206/372–379, 206/443, 488, 804, 815; 312/249.4, 334.4, 350, 902

(56) References Cited

U.S. PATENT DOCUMENTS

| | | | | |
|---|---|---|---|---|
| 3,550,978 | * | 12/1970 | Magee | 312/350 |
| 3,664,719 | * | 5/1972 | Berg | 312/902 |
| 4,502,741 | * | 3/1985 | DeVries et al. | 312/350 |
| 5,244,265 | * | 9/1993 | Chiang | 312/902 |
| 5,687,844 | * | 11/1997 | Budert | 206/372 |
| 5,878,882 | * | 3/1999 | Kohagura | 206/379 |

* cited by examiner

*Primary Examiner*—Paul T. Sewell
*Assistant Examiner*—Luan K. Bui

(74) *Attorney, Agent, or Firm*—William L. Chapin

(57) ABSTRACT

A drill case (10) includes a case box (20) having a longitudinally elongated rectangular cross-sectional shape closeable at one transverse end thereof by a lid (23). The case includes a slidably removable longitudinally elongated drill stand base (50) having in the upper surface thereof a plurality of longitudinally disposed, laterally spaced apart grooves (51) for receiving rectangular block-shaped drill stands (60) having longitudinally spaced apart vertical bores (61) for receiving drill bits (1). Stand base (50) has protruding outwardly from opposite lateral sides thereof a pair of parallel longitudinally disposed ribs (52) which are slidably receivable in a pair of upper or lower grooves (27) and (28) formed in the inner side walls of box (20), depending on whether short or long shank drill bits are contained in stands (60). Case (10) includes a shank retainer (70) for protecting the tips, including the cutting lips and points, of drill bits in drill stands (60), the retainer having through its thickness dimension a plurality of longitudinally and vertically disposed grooves (72) for receiving the tips of drill bits. Retainer (70) has a front end provided with a transversely disposed, front upper web (73F), and a rear end having a rear lower web (73R). Grooves (72) in retainer (70) have tapered lower entrance openings (90) for receiving the tapered transition section (5) between a drill bit shank (3) and tip (2), and cylindrical upper entrance openings (89) for receiving the shanks of drill bits. Two pairs of longitudinally disposed ribs (74) protruding from both upper and lower edges of retainer (70) are engageable with grooves (30) in box (20) with the retainer in either an upright or inverted position, thus configuring the case with tapered entrance openings facing downward to receive tapered transition sections of drill bits and thereby limit their movement, or with the cylindrical openings facing downward to receive the shanks of bits provided with insertion depth limiting rings.

20 Claims, 3 Drawing Sheets

DRILL BIT CASE WITH RE-CONFIGURABLE SHANK RETAINER AND STAND BASE

BACKGROUND OF THE INVENTION

A. Field of the Invention

The present invention relates to containers for storing and transporting twist drill bits. More particularly, the invention relates to a drill bit case that is re-configurable to store and protect drill bits of various types and sizes.

B. Description of Background Art

The manufacture of most Printed Wiring Boards (PWB's) of the type used to hold and electrically interconnect electronic circuit components requires the drilling of many small holes through the board. The holes are required for receiving component leads, or to constitute tunnels, the walls of which are subsequently electroplated to form an electrically conducting passageway or vias between various layers of the PWB. Most PWB's are fabricated as laminated stacks of conductive copper foil sheets adhered to alternating insulating sheets made of a material such as fiberglass, the latter containing glass fibers solidified with a resin such as epoxy. Conductive surface pathways on the PWB are formed by etching away portions of the copper foil layers. The glass fibers in the insulating layers of the PWB are highly abrasive, and can quickly dull drill bits used to drill holes in the PWB. Thus, most drill bits used in the manufacture of PWB's are tipped with carbide or a similar refractory material, which is very hard, but also brittle.

A typical PWB has a thickness of about 0.062 inch, and has hundreds of holes drilled through it. Frequently, holes are conveniently drilled simultaneously through a stack of vertically aligned PWB's, the stack consisting of two to five PWB's. Each contact of a drill bit with the upper PWB in a stack is referred to as a hit. Because the abrasive material of PWB board materials dulls typical drill bits after about 3,000–5,000 holes are drilled, the drill bit must be removed from service and re-sharpened after about 1,500–2,000 hits, i.e., after only as few as a dozen or so PWB's have been drilled. Thus, it can be appreciated that the manufacture of even modest quantities of PWB's requires frequent removal of worn or dull drill bits from a drilling machine at a drilling station where the PWB's are drilled, transport of the drill bits to a re-sharpening location, and transport of new or re-sharpened drill bits to the drilling machine station. PWB drill bits are typically small, having a standard shank diameter of about 3.175 mm, and a standard length of about 38.1 mm. Moreover, the diameter of the fluted, front cutting portion of a PWB drill bit, equal to the size of the diameter of the hole to be drilled, is usually quite small, in the approximate range of 0.6 mm down to 0.3 mm or less. Thus, typical PWB drills bits are fragile, being subject to breakage or chipping if either the fluted cutting lips or point of the bit impact another bit or another hard object. For this reason, PWB drill bits are generally stored and transported in some sort of protective container, which may, for example, utilize Styrofoam or other such cushioning material to protect the sharpened lips and points of the drill bits from being broken, cracked, chipped or dulled. Such containers desirably accommodate a plurality of drill bit stands, each holding a plurality of vertically oriented, longitudinally spaced apart drill bits. The drill bit stands are employed to facilitate automatic loading and unloading of drill bits from automatic drilling machines. Some PWB drill bits have annularly-shaped, depth control rings attached to the shank of the bit. The front annular surface of the ring is located at a pre-determined distance rearward from the point of the drill bit, and during automatic drilling operations, abuts a fixed structural element, thus limiting the insertion depth of the drill bit to a pre-determined value. Whether or not fitted with an insertion depth limiting ring, the length of the fluted front cutting portion of PWB drill bits varies to suit a particular application. Thus, because of the variety of sizes and configurations of PWB drill bits, presently available drill bit cases are generally not capable of suitably containing and protecting all of the various drill bits commonly used in PWB manufacturing.

Although it is stated in patent report No. 978216 that the invention disclosed therein can store both ringless drill bits and drill bits with rings, the case disclosed requires use of different drill stands, and requires a change of some parts of the case to accommodate drill bits of various types. The present invention was conceived of to provide a drill bit case which may store various types and sizes of PWB drill bits, without requiring exchange of parts of the case.

OBJECTS OF THE INVENTION

The object of the present invention is to provide a drill bit case for storing and protecting twist drill bits of various sizes from impacts which might crack, chip, or dull the cutting lips or points of the drill bits.

Another object of the invention is to provide a protective drill bit case adapted to hold a plurality of drill bit stands, each stand holding a plurality of drill bits, the case including a shank retainer for protecting the fluted front portion including the cutting lips and point of the bit from potentially damaging contact with other bits or other hard surfaces.

Another object of the invention is to provide a protective case for drill bits, the case including a drill stand base insertable into a lower portion of the case at a selected one of a plurality of heights, thereby locating the tips of drill bits of a selected one of a plurality of lengths held in drill stands at a desired height within a shank retainer in the upper portion of the case.

Another object of the invention is to provide a protective case for drill bits which includes a shank retainer provided with a plurality of laterally spaced apart vertically disposed grooves alternating with vertically disposed side walls for preventing contact between the front cutting portion of drill bits in adjacent laterally spaced apart rows.

Another object of the invention is to provide a protective case for drill bits which includes a shank retainer provided with a plurality of laterally spaced apart vertically disposed grooves for receiving the shanks of drill bits in adjacent laterally spaced apart rows, and protecting the front cutting portions of the drill bits in adjacent rows from potentially damaging mutual impact, a first, lower surface entrance opening of each of the grooves having a pair of laterally opposed, longitudinally disposed, inwardly projecting ribs forming an inwardly tapered entrance opening for receiving the tapered transition section joining the shank and front cutting portion of drill bits, the second opposite longitudinally disposed surface of the retainer having groove entrance openings of larger diameter than the drill bit shanks, thereby permitting free insertion of the drill bit shanks.

Another object of the invention is to provide a protective case for drill bits which includes a shank retainer having parallel upper and lower longitudinally disposed surfaces, and a plurality of parallel, longitudinally disposed laterally spaced apart grooves disposed vertically between said upper and lower surfaces, the width of the grooves and the entrance openings thereto in the upper or lower surface being greater than the diameter of the shanks of drill bits which the case is intended to be used with, and the entrance opening to the groove in the opposite surface of said shank retainer having a width sufficient to receive the tapered transition section of a drill bit between the shank and cutting portion of the bit, said entrance opening being tapered inwardly to a width smaller than the diameter of said shank to thereby limit travel of said bit into said grooves through said tapered entrance openings, said shark retainer being removably and reversibly installable in the upper portion of said case in either of two positions, with said full-width groove entrance openings or said tapered groove entrance openings, respectively, facing the lower portion of said case.

Another object of the invention is to provide a protective case for drill bits having a drill stand base adapted to receive at one of a plurality of heights with respect to the bottom wall of the case a plurality of laterally spaced apart drill stands, each holding a plurality of vertically disposed, longitudinally spaced apart drill bits, and a block-shaped shank retainer located above said drill stands, said shank retainer having through its thickness dimension a plurality of longitudinally disposed, laterally spaced apart grooves located above and vertically aligned with said drill bit stands, said retainer grooves having in a first longitudinally disposed upper or lower surface of said block an opening of a width sufficient to insertably receive the shanks of said drill bits, and in the opposite, lower or upper parallel longitudinally disposed surface thereon an inwardly tapered entrance opening having an inner width less than the diameter of said drill bit shanks to thereby limit inward travel of said drill bits into said grooves, said shank retainer being alternately and re-configurably installable in said case with either said full-width entrance openings or said tapered entrance openings facing downwards towards said drill bits.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends a protective storage case for containing a quantity of twist drill bits, while protecting the bits from potentially damaging contact with each other or with other objects during transport of the container. The protective drill bit case according to the present invention is constructed to receive a plurality of drill bit stands, each containing a plurality of drill bits, and is of re-configurable construction which provides safe storage of drill bits of various sizes, and with and without insertion depth control rings attached to the shanks of the bits.

The protective drill bit case according to the present invention includes a longitudinally elongated rectangular cross-section case box having a closed rear transverse end wall, and a hinged front lid securable to the front transverse end of the box. The case includes a longitudinally elongated, slidably removable drill stand base having formed in the upper surface thereof a plurality of longitudinally disposed, laterally spaced apart grooves each capable of slidably receiving a separate one of a plurality of rectangular block-shaped drill stands having protruding from the upper surface thereof a plurality of vertically disposed, longitudinally spaced apart bores each adapted to receive the shank of a drill bit. The drill stand base has protruding outwardly from laterally opposed, opposite longitudinal side walls thereof a pair of parallel longitudinally disposed ribs which are slidably receivable in either an upper or lower pair of grooves formed in the inner facing side walls of the box, depending on whether short or long drill bits are contained in the stands.

According to the present invention the protective drill bit case includes a protective shank retainer longitudinally slidably receivable in either of two orientations in the upper portion of the case, for preventing contact between drill bits in adjacent rows. The shank retainer has a generally rectangular block-shape in which is formed a plurality of rectangular cross-section, laterally spaced apart: grooves which extend between the upper and lower parallel longitudinally disposed surfaces of the block and alternate with uncut portions of the block that form vertically disposed, rectangular cross-section, slab-shaped walls.

The shank retainer has at the lower rear edge of the block a transversely disposed lower rear web and at the upper front edge thereof a transversely disposed upper front web. The grooves in the retainer block extend longitudinally from the rear transverse end wall of the block to the rear surface of the upper front web, and from the front transverse end wall of the block to the front surface of the lower rear web.

In either an upper or lower horizontally disposed longitudinal surface of the retainer block, a longitudinally elongated rectangular entrance opening of each groove is of the same width as the groove, which is of a size sufficient to insertably receive the shanks of drill bits. In the opposite horizontally disposed longitudinal surface of the block, the longitudinally elongated rectangular entrance opening at the opposite end of each groove has formed in the laterally opposed side walls of the groove a pair of laterally opposed, longitudinally disposed triangular ribs that cause the entrance opening to be inwardly tapered. The tapered entrance opening is of the proper size to admit the tapered transition section between the shank and front cutting portion of a drill bit, but prevent the bit from further vertical travel into the groove.

The shank retainer has provided in the opposite vertical side walls thereof a pair of laterally opposed, outwardly protruding, longitudinally disposed ribs slidably engagable in a pair of complementarily-shaped longitudinally disposed grooves formed between longitudinally disposed ribs which protrude inwardly from the inner surfaces of opposite vertical side walls of the case box, and the lower wall surface of the upper wall of the box interior. With this arrangement, the shank retainer may be installed in the case box with the tapered entrance openings of the shank retainer block grooves facing downward to receive the tapered transition sections of drill bits held upright in drill stands, thereby limiting upward motion of the drill bits and preventing contact of the drill bit tips with any interior surface of the case. Alternatively, the case may be re-configured by sliding the shank retainer block outward from the case, inverting and reversing the retainer block, and re-inserting the block into the case with the full-width entrance openings of the grooves facing downwards to receive the shanks of inverted drill bits fitted with insertion depths limiting rings, upward and downward motion of the front cutting portions of the bits into the shank retainer grooves and the drill stand bores being limited by contact of the rings with the lower surface of the shank retainer or the upper surface of the drill stand, respectively, thereby preventing contact of the drill bit point with any interior surface of the case.

BRIEF DESCRIPTION OF THE DRAWINGS

FIG. 1(*b*) is an elevation view of one type of drill bit which the case of FIG. 1(*a*) is intended to hold.

FIG. 2(*b*) is a broken away upper plan view of the case of FIG. 1.

FIG. 2(*c*) is a longitudinal sectional view of the case of FIG. 2(*a*), taken along line A—A.

FIG. 3(*b*) is a bottom plan view of the retainer block of FIG. 3(*a*).

FIG. 3(*c*) is a rear elevation view of the retainer block of FIG. 3(*a*).

FIG. 3(*d*) is an upper plan view of the retainer block of FIG. 3(*a*).

FIG. 3(*e*) is a vertical transverse sectional view of the retainer block of FIG. 3(*d*), taken along line B—B.

FIG. 3(*f*) is a rear perspective view of the retainer block of FIG. 3(*a*).

FIG. 4(*b*) is a front sectional view showing the case of FIG. 1 with the removable shank retainer block thereof installed in a second, alternate configuration to that shown in FIG. 4(*a*), in which second alternate position tapered entrance openings of grooves in said shank retainer block are located at the upper side of said retainer block, the full width entrance openings being located on the lower side of the block to thereby receive the shanks of drill bits in either an upright position or inverted position.

DESCRIPTION OF THE PREFERRED EMBODIMENTS

FIGS. 1–4 illustrate a drill bit case with a reconfigurable shank retainer and drill stand base according to the present invention.

Figure 1A:
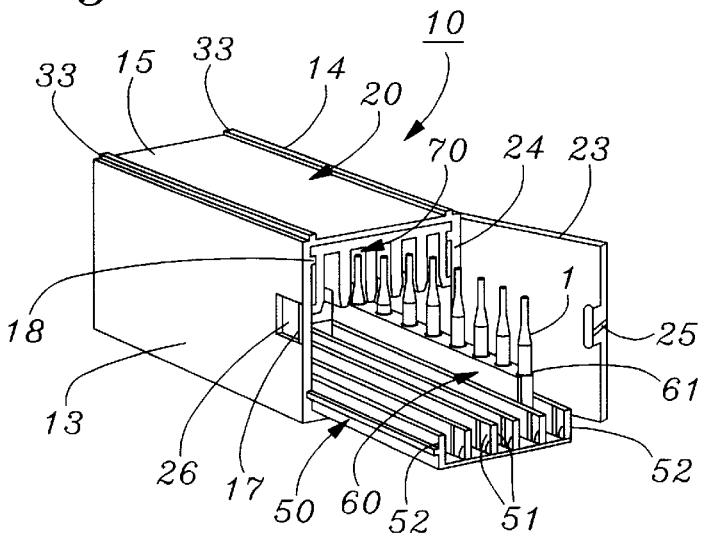
FIG. 1(*a*) is a front perspective view of a protective drill bit case with re-configurable shank retainer and stand base according to the present invention.
Figure 1B:
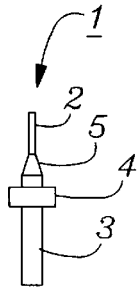
Figure 2A:
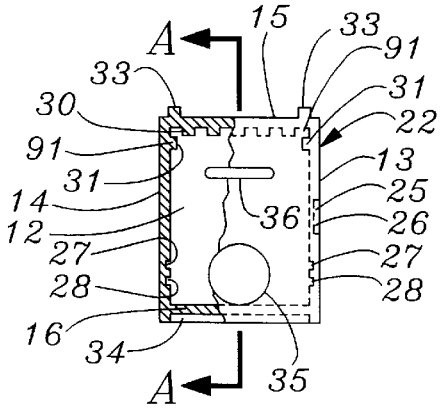
FIG. 2(*a*) is a broken away rear elevation view of the case of FIG. 1.
Figure 2C:
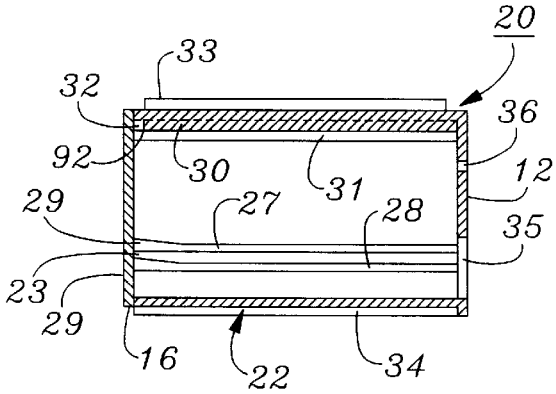
Figure 2B:
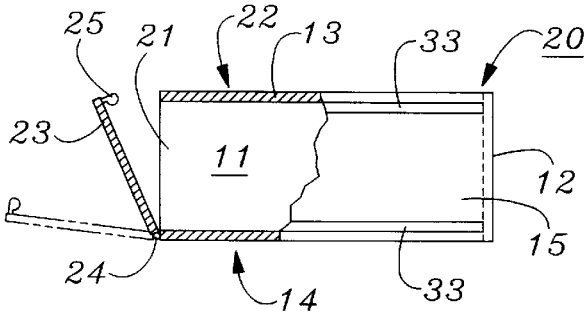
Figure 3A:
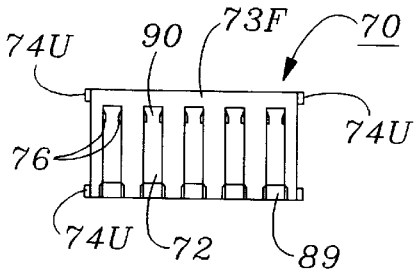
FIG. 3(*a*) is a front elevation view of a shank retainer block comprising a removable component of the case of FIG. 1.
Figure 3B:
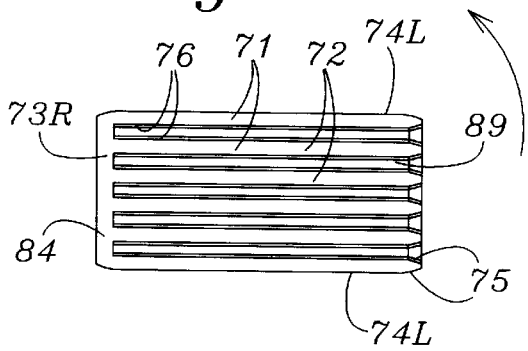
Figure 3C:
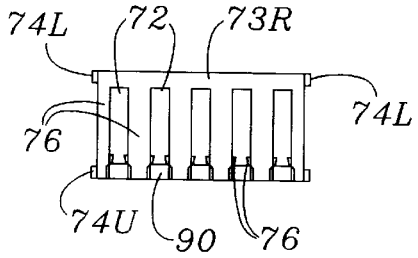
Figure 3D:
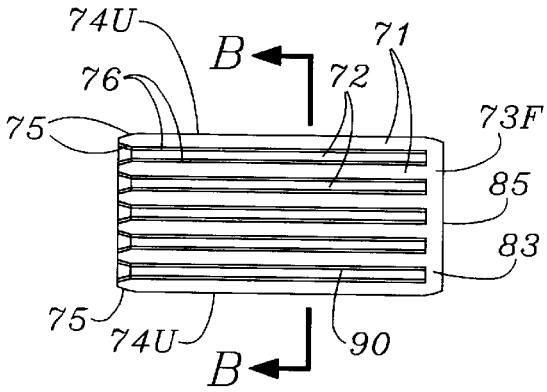
Figure 3E:
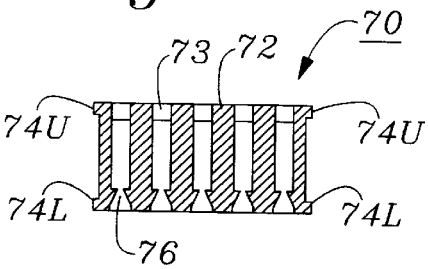
Figure 3F:
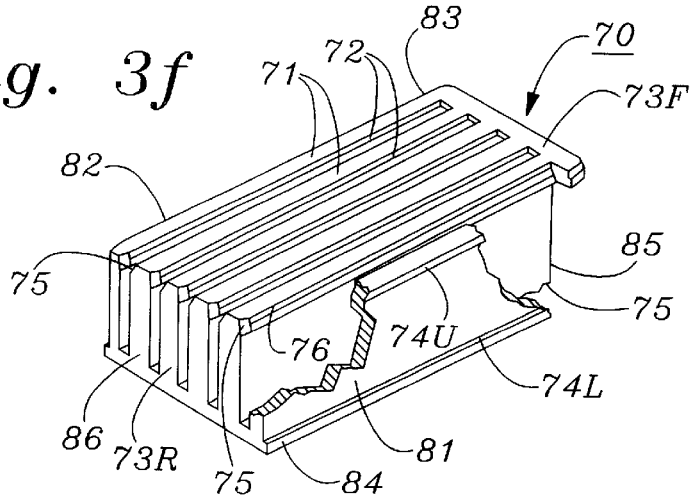

Referring first to FIG. 1(*a*), a drill bit case 10 according to the present invention may be seen to include a longitudinally elongated case box 20 having a vertically elongated, rectangularly-shaped transverse cross section. Case box 20 includes a shell 22 which has a hollow interior space 11 defined within walls comprising a rear wall 12 (as shown in FIG. 2(*a*)), left and right vertically disposed side walls 13 and 14, and upper and lower horizontally disposed walls 15 and 16, respectively.

As may be seen best by referring to FIGS. 1(*a*) and 2(*b*), case box 20 has a front entrance opening 21 which is closable by means of a lid 23 attached to right side wall 14 of the case box by a vertically disposed hinge 24, which may be a self hinge. Lid 23 has protruding perpendicularly rearward from the center part of the left edge thereof a latching member 25, which is adapted to lockingly engage a vertically disposed rib 17 located at the front portion of a rectangularly-shaped depression 26 formed in left side wall 13 of the case box, near the front vertical edge wall 18 of the left side wall. By pivoting lid 23 into contact with front vertical edge wall 18 of left side wall 13, latching member 25 is elastically deformed to lockingly engage rib 17 in depression 26 of the side wall, thus securing interior space 11 of case box 20 and its contents.

Referring now to FIGS. 1(*a*), 2(*a*), and 2(*b*), it may be seen that drill bit case 10 includes a drill stand base 50 which is longitudinally slidably receivable into and removable from a lower portion of interior 11 of case box 20. As shown in FIG. 1, drill stand base 50 has a uniform, generally rectangular transverse cross sectional shape having formed in the upper surface thereof a plurality of longitudinally disposed, laterally spaced apart channel-shaped grooves 51. Grooves 51 have a rectangular transverse cross section, and are each adapted to insertably receive a rectangular block-shaped drill stand 60. Each drill stand 60 has a plurality of longitudinally spaced apart bores 61 that protrude vertically downwardly into the stand from the upper surface of the stand, each of which bores is of slightly larger diameter than that of the shank 3 of a drill bit 1 which the stand is intended to accommodate.

As shown in FIG. 1, stand base 50 has protruding laterally outwards from opposite lateral sides thereof a pair of longitudinally disposed, horizontally aligned ribs 52, which are adapted to be slidably receivable in either an upper pair 27 or lower pair 28 of grooves formed in the inner surfaces of left and right side walls 13 and 14 of case box 20. As shown in FIG. 2(*a*), groove pair 28 is spaced at a first height above the upper surface of base wall 16 of case box 20, and groove pair 27 is spaced at a second, greater height above the base wall. With this construction, drill stand base 50 may be installed in case box 20 in either of two height configurations. As shown in FIG. 2(*c*), the front entrance openings 29 of grooves 27 and 28 taper forwardly and outwardly to facilitate insertion of drill stand base ribs 52 into the grooves As shown in FIG. 2(*a*), rear wall 12 of case box 20 preferably has therethrough a circular hole 35 laterally centered and located near base wall 16 of the case box. Hole 35 is provided to permit insertion of a finger or other object to push drill stand base 50 out of case box 20 when it is desired to remove drill stand base 50 and drill stands 60 from the case box.

As shown in FIG. 1, drill bit case 10 includes a shank retainer 70 which is longitudinally slidably receivable into and removable from an upper portion of interior 11 of case box 20. As will be explained in detail below, shank retainer 70 functions as a protective structure to prevent movement of drill bits 1 within case box 20 which could allow potentially damaging mutual contact between drill bits held in adjacent drill stands 60.

Referring now to FIG. 3(*f*), it may be seen that shank retainer 70 has an overall outline shape approximating that of a longitudinally elongated block having a laterally elongated, rectangular transverse cross section, vertically disposed left and right side walls 81 and 82, and horizontally disposed upper and lower walls 83 and 84, respectively; and front and rear vertically disposed walls 85 and 86. Shank retainer 70 has formed therein a plurality of longitudinally elongated, rectangular cross-section grooves 72 which extend between upper wall 83 and lower wall 84 of the shank retainer. As shown in FIG. 3(*d*), grooves 72 alternate laterally with uncut portions of the retainer block that form vertically and longitudinally disposed, slab-shaped walls 71 which laterally border each groove.

As may be seen by referring to FIG. 3(*a*), in conjunction with FIG. 3(*d*), grooves 72 terminate at front ends thereof at the rear transverse edge of a square cross-section, horizontally and laterally disposed front upper, elongated web 73F comprising an uncut portion of the retainer block. Also, as shown in FIG. 3(*a*), the front portions of grooves 72 terminate at the upper end thereof at the lower transverse edge of web 73F. In an exactly analogous manner, as shown in FIGS. 3(*c*) and 3(*b*), grooves 72 terminate at the rear end thereof at the front transverse edge of a square cross section, horizontally and laterally disposed elongated rear lower web 73R comprising an uncut portion of the retainer block. Also, as shown in FIG. 3(*c*), the rear portion of grooves 72 terminate at the lower ends thereof at the upper transverse edge of web 73R.

As shown in FIGS. 1(*a*) and 1(*b*), the lower entrance openings 89 of grooves 72 of shank retainer 70 are of the same lateral width as the grooves, and of a size slightly greater than the diameter of the shanks of drill bits which the retainer is intended to be used with. On the other hand, the upper entrance openings 90 of grooves 72 are laterally inwardly and downwardly tapered, to permit partial insertion of the frusto-conically shaped transition section 5 of a drill bit 1, but limiting further movement of the drill bit into the groove. Thus, as shown in FIG. 1(*a*), each upper entrance opening 90 of a groove 72 has formed in the opposite side walls of the groove a pair of laterally opposed, laterally inwardly protruding, longitudinally disposed triangular cross section ribs 76, causing the entrance openings to be inwardly tapered.

The construction of drill bit case 10 which enables shank retainer 70 to be longitudinally slidable into and out of case box 20 may be best understood by referring to FIGS. 1 and 2(*a*). In addition to FIG. 3(*a*). Thus, as shown in FIG. 2(*a*), the inner surfaces of left and right side walls 13 and 14 of case box 20 are provided with a pair of horizontally opposed and aligned, laterally inwardly protruding, square cross-section ribs 31. As shown in FIG. 2(*c*), ribs 31 are spaced a short distance, approximately the height of the rib, below the inner surface of upper wall 15 of case box 20, are longitudinally disposed, and span the length or depth of the case box. Thus arranged, ribs 31 form between the upper surface thereof and the lower surface of upper wall 15 of case box 20 a pair of laterally opposed longitudinally disposed grooves 91 which span the length of case box 20.

Grooves 91 are adapted to receive either of two pairs of longitudinally disposed, horizontally aligned ribs 74 which protrude laterally outwards from opposite lateral sides of shank retainer 70. As shown in FIGS. 3(*a*), 3(*c*) and 3(*f*), ribs 74U of the upper pair of ribs has an upper surface coextensive with the upper surface of shank retainer block 70 and front and rear surfaces coextensive with the front and rear surfaces of the shank retainer, thus forming upper side rims of the shank retainer block. In an exactly similar construction, each rib 74L of the lower rib pair has a lower surface coextensive with the lower surface of shank retainer block 70, and front and rear surfaces coextensive with the front and rear surfaces of the shank retainer block, thus forming lower side rims of the shank retainer block. As shown in FIG. 3(*d*), the lateral edges of upper ribs 74U near the rear entrance opening of grooves 72 are tapered inwardly near their longitudinal ends, as indicated by the numeral 75, as are those of the upper ends of slab walls 71, in an exactly similar construction, as shown in FIG. 3(*b*), the lateral edges of lower ribs 74L near the front entrance openings of grooves 72, and the lower ends of slab walls are tapered inwardly. Tapered surfaces 75 facilitate insertion of ribs 74 into grooves 91 of case box 20.

As shown in FIGS. 2(*a*) and 2(*c*), case box 20 optionally and preferably is provided with a plurality of laterally spaced apart, longitudinally disposed downwardly protruding, rectangular cross-section positioning ribs 30 horizontally aligned with and located between grooves 91. Positioning ribs 30 are of the proper size and mutual relationship to be longitudinally slidably received into grooves 72 of shank retainer 70, when the installation ribs 74 of the retainer block are inserted into grooves 91, further securing the retainer block within case box 20. Positioning ribs 30 also function as a keying structure, which prevents improper installation of shank retainer block 72 into case box 20, i.e., with an upper web 73 towards the rear of the case box, since abutting contact of a web thus positioned with the front ends of the positioning ribs prevents a mis-oriented retainer block from being slid into the case box. As shown in FIG. 2(*c*), the front transverse edges 92 of positioning ribs 30 are spaced inwards from the rim of entrance 21 of the case box, thus providing a gap 32 to accommodate the upper front web 73 of a retainer block 72 installed in the case box with lid 23 closed.

The manner of re-configuring drill case 10 to accommodate various sizes and types of drill bits may be best understood by referring to FIGS. 1, 3(*d*) and 3(*b*).

Figure 4A:
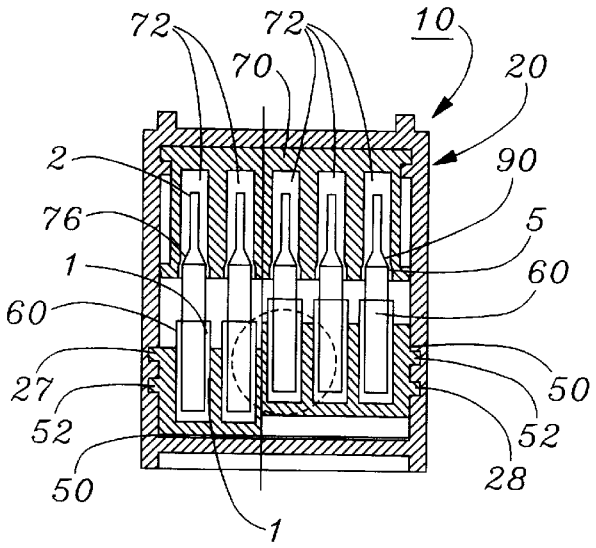
FIG. 4(*a*) is a front sectional view of the case of FIG. 1, with the removable shank retainer block thereof installed in a first alternate configuration in which the tapered entrance openings of grooves in said shank retainer block are located at the lower side of said retainer block, to thereby receive the transition section of drill bits and limit upward motion of the bits into the grooves, and showing a removable drill stand base thereof installed alternatively at lower and higher locations within the box to accommodate drill bit stands containing bits with long shanks and short tips, and short shanks and long tips, respectively.
Figure 4B:
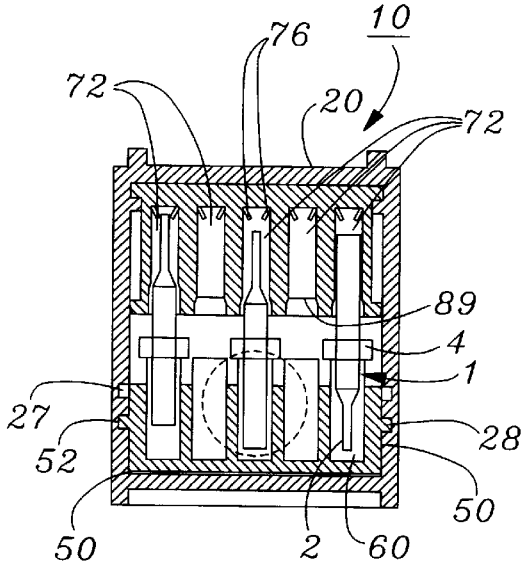

Referring first to the left-hand side of FIG. 4(*a*), a drill stand base 50 is shown installed at the lower of two possible elevations within the lower portion of case box 20, i.e., with ribs 52 of the stand base inserted into lower locating grooves 28. FIG. 4(*a*) also shows shank retainer 70 installed within the upper portion of case box 20 with the tapered entrance openings 90 to grooves 72 of the shank retainer facing down. For this configuration of shank retainer 70 before the shank retainer is inserted into case box 20, it is inverted to the orientation shown in FIGS. 3(*c*) and 3(*b*), rotated 180 degrees in a horizontal plane as indicated by the arrow in FIG. 3(*b*), and inserted into case box 20 in the manner described above and shown in FIG. 1. With this configuration of shank retainer 70, as shown in the left-hand side of FIG. 4(*a*), ribs 76 of tapered lower entrance openings 90 of grooves 72 contact the tapered transition sections 5 of drill bits 1, preventing further upward movement of the bits into grooves 72 and thereby protecting the tips 2 of the bits from contacting one another or the interior of the drill case. The right-hand side of FIG. 4(*a*) shows drill case 10 having the same configuration of shank retainer 70, but with ribs 52 of stand base 50 inserted into upper grooves 27 in the inner side walls of case box 20. With this configuration of stand base 50, drill bits having shorter shank lengths are positioned higher within case box 20, thus positioning transition sections 5 of the bits properly to contact ribs 76 of shank retainer grooves 72.

FIG. 4(*b*) illustrates a second configuration of shank retainer 70 within case box 20 of drill case 10, different from the first configuration shown in FIG. 4(*a*). To re-configure shank retainer 70 from the orientation shown in FIG. 4(*a*) to that shown in FIG. 4(*b*), the shank retainer is first removed through front entrance opening 21 of the case box. This operation may be facilitated by inserting an object such as a screwdriver into slotted opening 36 through rear wall 12 of the case box, and thrusting the screwdriver tip forward to push against the rear wall of shank retainer 70.

With shank retainer 70 removed from case box 20, the shank retainer is inverted to the orientation shown in FIG. 3(*a*), and rotated 180 degrees in a horizontal plane to the orientation shown in FIG. 3(*d*), and re-inserted into case box 20. In this configuration of shank retainer 70, as shown in FIG. 4(*b*), the full-width entrance openings 89 of shank retainer grooves 72 face downward. Thus, the shanks 3 of drill bits 1 contained in drill stands 60 held in drill stand base 50 are freely movable longitudinally within grooves 72 of the shank retainer. However, since the configuration of drill stand case 10 shown in FIG. 4(*b*) is intended for use with drill bits 1 fitted with insertion depth limiting rings 4, longitudinal travel of the bits within drill stand bores 61 and shank retainer grooves 70 is limited by contact of the rings with the upper surface of the drill stands and the lower surface of the shank retainer block, respectively, thus protecting the tips 2 of the drill bits from potentially damaging impacts.

As shown in FIG. 4(*b*), drill bits 1 with depth rings 4 located at different distances from the point of the drill bit may be accommodated within bores 61 of drill stands 60 and grooves 72 of shank retainer 70. As shown in the right-hand side of FIG. 4(*b*), drill case 10 may also accommodate inverted drill bits 1, which may be thus positioned to indicate that a bit is worn or defective, for example.

In a preferred embodiment of drill bit case 10, drill stand base 50 is provided with five grooves 51 for receiving five drill stands 60, each of which can support 10 drill bits, and shank retainer 70 is provided with five grooves 72 which are vertically aligned with grooves 51 when the drill stand base and shank retainer 70 are installed in case box 20. In this embodiment of case 10, it is possible to store 50 drill bits in the case.

Case box 20 is preferably constructed so that a plurality of such case boxes may be vertically stacked and handled as a unit. Thus, as shown in FIGS. 1, 2(*a*) and 2(*c*), upper wall 15 of case box 20 has protruding upwards from the upper surface thereof a pair of laterally opposed, longitudinally disposed stacking ribs 33. As may be seen best by referring to FIG. 2(*a*), ribs 33 are spaced laterally inward a short distance from the side walls of case box 20, and are adapted to be snappingly received in a concave rectangularly-shaped depression 34 in the lower portion of another case box. As shown in FIG. 2(*a*), depression 34 may be defined by flange extensions of the side walls and front wall of the case box, which extensions protrude downwardly below the lower surface of case base wall 16.

What is claimed is:

1. A drill bit case for storing twist drill bits comprising:

(a) a case box having a hollow interior space closed at a rear transverse end thereof and having at a front transverse end thereof an opening closable by a lid, (b) a drill stand base provided with a plurality of longitudinally disposed, laterally spaced apart drill stand grooves for receiving in each one thereof a rectangular block-shaped drill stand having therein longitudinally spaced apart, vertically disposed bores for receiving in each one thereof a separate drill bit, said drill stand case being removably receivable in said case box, and (c) a shank retainer for preventing contact between drill bits held in said bores of adjacent ones of said drill stands, said shank retainer having through its thickness dimension a plurality of longitudinally disposed shank grooves for receiving said shanks of said drill bits, said shank grooves being vertically aligned with said drill stand grooves in said drill stand base.

2. The drill bit case of claim 1 wherein said case box is further defined as including means for removably receiving said drill stand base at a selected one of a plurality of heights above a base wall of said case box, thereby locating drill bits within said bores of said drill stands at a selected height within said bit grooves of said shank retainer.

3. The drill bit case of claim 2 wherein said means for removably receiving said drill stand base at a selected one of a plurality of heights within said case box comprises in combination a pair of laterally opposed longitudinally disposed base ribs protruding laterally outwards from opposite lateral sides of said drill stand base, and a plurality of pairs of longitudinally disposed base grooves in the inner sides of opposite lateral walls of said case box, said base grooves pairs located at different heights from said base wall of said case box.

4. The drill bit case of claim 1 wherein said shank retainer is further defined as having longitudinally disposed entrance openings to said shank grooves thereof in a first longitudinally disposed horizontal surface of said retainer of a width at least as great as that of said shank grooves and greater than the diameter of the shanks of the drill bits which said retainer is intended to be used with.

5. The drill bit case of claim 4 wherein said shank retainer is further defined as being removably receivable within said case box.

6. The drill bit case of claim 4 wherein said shank retainer is further defined as having in a second longitudinally disposed horizontal surface thereof longitudinally disposed entrance openings to said shank grooves which are inwardly tapered to a width greater than the diameter of the tips of said drill bits, but less than the diameter of said shanks of said drill bits, said tapered entrance openings being adapted to conformally receive the tapered transition section between the tip and shank of said drill bits and thereby limit longitudinal travel of said drill bits into said shank grooves.

7. The drill bit case of claim 6 wherein said case box is further defined as including means for removably receiving said shank retainer at alternative orientations, i.e., with said first or second longitudinally disposed horizontal surface facing downwards toward said drill stand base.

8. The drill bit case of claim 7 wherein said means for removably receiving said shank retainer at a selected one of said orientations is further defined as comprising in combination an upper and lower pair of longitudinally disposed retainer ribs protruding from opposite upper and lower margins of said shank retainer, and a pair of laterally opposed, longitudinally disposed retainer grooves in the inner sides of opposite lateral walls of said case box.

9. The drill bit case of claim 8 wherein said shank grooves are further defined as vertically spanning the distance between said upper and lower surfaces of said retainer, and spanning the longitudinal distance between the rear surface of said retainer, said shank grooves thereby defining adjacent slab-shaped side walls secured at an upper front lateral edge thereof by a first laterally disposed, upper front web rib, and at the lower rear lateral edge thereof by a second, laterally disposed lower rear web rib.

10. A drill bit case for storing twist drill bits comprising:

(a) a longitudinally elongated, rectangular cross section case box having a rear transverse wall, a pair of longitudinally disposed vertical side walls, an upper wall and a base wall defining therewithin a hollow interior space, said case box having at a front transverse end thereof a lid fastenable to said case box, said case box having in the inner sides of opposite side walls thereof a plurality of horizontally aligned, longitudinally disposed stand base grooves for receiving a drill stand base, said stand base groove pairs located at different heights from said base wall of said case box, and said case box having formed in the inner sides of upper portions of opposite side walls thereof a pair of horizontally aligned, longitudinally disposed shank retainer grooves for receiving a shank retainer, (b) a drill stand base having in an upper surface thereof a plurality of longitudinally disposed, laterally spaced apart drill stand grooves for receiving a plurality of rectangular block-shaped drill stands each having therein a plurality of longitudinally spaced apart, vertically disposed bores for receiving in each one thereof a separate drill bit, said drill stand base having protruding outwardly from opposite lateral sides thereof a pair of longitudinally disposed base ribs adapted to be longitudinally slidably received within a selected pair of stand base grooves, thereby locating said stand base a selected pre-determined height within said case box, and (c) a shank retainer for preventing contact between drill bits held in said bores of adjacent ones of said drill stands, said shank retainer having a rectangular block shape with first and second parallel horizontal surfaces and having through its thickness dimension a plurality of vertically and longitudinally disposed shank grooves vertically aligned with said drill stand grooves of said drill stand base, for receiving the tips or shanks of drill bits held in upright or inverted positions, respectively, within said bores of said drill stands.

11. The drill bit case of claim 10 wherein said case box is further defined as including means for removably receiving said shank retainer within said case box.

12. The drill bit case of claim 11 wherein said shank retainer is further defined as having longitudinally disposed entrance openings to said shank grooves in said first horizontal surface of said shank retainer of a width at least as great as that of said shank grooves, and longitudinally disposed entrance openings to said shank grooves in said second horizontal surface thereof which are inwardly tapered to a width greater than the diameter of the tips of said drill bits but less than the diameter of said shanks of said drill bits, said tapered entrance openings being adapted to conformally receive the tapered transition section between the tip and shank of said drill bits and thereby limit longitudinal travel of said drill bits vertically upward into said shank grooves.

13. The drill bit case of claim 12 wherein said means for removably receiving said shank retainer within said case box is further defined as allowing installation of said shank retainer with alternative and reversibly with either said full-width entrance openings or said tapered entrance openings of said shank grooves facing downwards towards said drill stand base.

14. The drill bit case of claim 13 wherein said means for removably receiving said shank retainer within said case box is further defined as comprising in combination an upper and lower pair of retainer ribs protruding form opposite upper and lower margins of said shank retainer, and a pair of laterally opposed longitudinally disposed retainer grooves in the inner side walls of opposite vertical side walls of said case box.

15. The drill bit case of claim 14 wherein said shank grooves are further defined as vertically spanning the distance between said first and second surfaces of said retainer, and spanning the longitudinal distance between the front and rear surfaces of said retainer, said grooves thereby defining slab-shaped side walls secured at an upper front lateral edge thereof by a first laterally disposed upper front web and at the lower rear lateral edge thereof by a second, laterally disposed lower rear web rib.

16. The drill bit case of claim 15 wherein said retainer grooves are further defined as being formed between a laterally opposed inwardly protruding pair of upper side ribs disposed longitudinally a distance below the inner surface of said upper wall of said case box, said distance defining the height of said retainer grooves.

17. The drill bit case of claim 16 further including a plurality of laterally spaced apart longitudinally disposed rectangular cross section ribs protruding downwardly from the lower inner surface of the upper wall of said case box, said ribs being of the proper size and mutual relationship to be longitudinally slidably receivable into said shank grooves of said shank retainer with said retainer ribs engaged with said retainer grooves.

18. The drill bit case of claim 17 wherein said positioning ribs are further defined as having front transverse edge walls spaced inwardly from the rim of the entrance to said case box, thereby providing a space to accommodate said upper front web of said shank retainer with the latter inserted into said case box.

19. The drill bit case of claim 18 wherein said rear wall of said case box is provided with an aperture adjacent a rear surface of said drill stand base for receiving an object to push said drill stand base out from said case box.

20. The drill bit case of claim 18 wherein said rear wall of said case box is provided with an aperture adjacent a rear surface of said shank retainer for receiving an object to push said shank retainer out from said case box.

* * * * *